US010874579B1

(12) United States Patent
Rembert

(10) Patent No.: US 10,874,579 B1
(45) Date of Patent: Dec. 29, 2020

(54) WEARABLE MASSAGER

(71) Applicant: Reginald Rembert, Flower Mound, TX (US)

(72) Inventor: Reginald Rembert, Flower Mound, TX (US)

( * ) Notice: Subject to any disclaimer, the term of this patent is extended or adjusted under 35 U.S.C. 154(b) by 1089 days.

(21) Appl. No.: 15/067,488

(22) Filed: Mar. 11, 2016

Related U.S. Application Data

(60) Provisional application No. 62/131,360, filed on Mar. 11, 2015.

(51) Int. Cl.
*A61H 15/00* (2006.01)
*A61H 9/00* (2006.01)

(52) U.S. Cl.
CPC ..... *A61H 15/0078* (2013.01); *A61H 9/0078* (2013.01)

(58) Field of Classification Search
CPC ..... A61H 9/0092; A61H 11/02; A61H 2015/0014; A61H 2015/0078; A61H 23/02; A61H 23/04; A61H 23/006; A61H 23/0254; A61H 2201/1207; A61H 2201/1215; A61H 2201/123; A61H 2201/1481; A61H 2201/1489; A61H 2201/1501; A61H 2201/1652; A61H 2201/1664; A61H 2201/1669; A61H 2201/5043; A61H 2207/00
USPC ..... 601/46, 49, 51, 52, 56–62, 93, 94, 601/97–103
See application file for complete search history.

(56) References Cited

U.S. PATENT DOCUMENTS 3,675,644 A * 7/1972 Laskowitz ..... A61H 15/00 601/103
4,979,502 A * 12/1990 Hunt ..... A61H 23/02 601/15
5,142,717 A 9/1992 Everard et al.
5,395,301 A * 3/1995 Russek ..... A61H 31/00 600/27
5,487,723 A * 1/1996 Ito ..... A61H 15/0078 601/102
5,749,838 A * 5/1998 Kline ..... A61B 5/1077 340/573.7
6,036,662 A 3/2000 Van Brunt et al.
(Continued)

FOREIGN PATENT DOCUMENTS

WO WO 2004/084790 10/2004
WO WO 2009/145600 12/2009
WO WO 2014/120094 8/2014

*Primary Examiner* — Justine R Yu
*Assistant Examiner* — Alexander Morales
(74) *Attorney, Agent, or Firm* — Kenneth L Tolar

(57) ABSTRACT

A wearable massager includes a plurality of attachments, each of which is designed for a specific body part. Each attachment includes at least one massaging module on an inner surface that is either formed of mechanical rollers that simulate a massage as they are moved vertically and horizontally, or a plurality of contiguous, inflatable bladders that simulate a massage as they are inflated and rapidly deflated. A controller allows a user to vary the speed and intensity with which the rollers are moved horizontally and vertically, or the level, order and frequency in which each bladder is inflated and deflated. Accordingly, the continuous movement of the rollers or inflation and deflation of the bladders against the wearer's skin simulates the typical movements of a massage therapist's hands and fingers.

4 Claims, 3 Drawing Sheets

(56) References Cited

U.S. PATENT DOCUMENTS 6,193,678 B1 * 2/2001 Brannon ..... A61H 23/0263 601/15
6,224,563 B1 * 5/2001 Nonoue ..... A61H 15/0078 601/99
6,361,512 B1 * 3/2002 Mackay ..... A61H 9/0078 601/149
6,432,072 B1 * 8/2002 Harris ..... A61H 23/0254 601/101
6,454,732 B1 * 9/2002 Lee ..... A61F 7/00 601/101
6,475,171 B1 * 11/2002 Williams ..... A61H 7/002 601/100
7,207,953 B1 4/2007 Goicaj
7,354,410 B2 4/2008 Perry et al.
8,231,558 B2 * 7/2012 Singh ..... A61B 17/1325 601/148
8,394,041 B2 * 3/2013 Ferber ..... A61H 7/00 601/101
8,439,948 B1 * 5/2013 King ..... A61G 13/123 606/241
D712,059 S 8/2014 Sedic
8,905,953 B2 * 12/2014 Singh ..... A61B 17/1325 601/148
2003/0018284 A1 * 1/2003 Lim ..... A61H 7/00 601/98
2004/0106882 A1 * 6/2004 Tseng ..... A61H 7/004 601/86
2004/0127822 A1 * 7/2004 Eisenberg ..... A45D 44/02 601/49
2005/0049530 A1 * 3/2005 Kim ..... A61H 15/00 601/99
2005/0065580 A1 * 3/2005 Choi ..... A61F 7/00 607/96
2007/0027413 A9 * 2/2007 Koch ..... A61H 1/00 601/99
2007/0049852 A1 * 3/2007 Linnane ..... A61F 5/0127 601/151
2007/0088235 A1 4/2007 Tseng
2009/0247917 A1 * 10/2009 Park ..... A61H 1/0222 601/99
2010/0179456 A1 * 7/2010 Chen ..... A61H 15/00 601/18
2014/0005579 A1 1/2014 Drlik et al.
2014/0276271 A1 * 9/2014 Stryker ..... A61H 23/04 601/46

* cited by examiner

WEARABLE MASSAGER

CROSS REFERENCE TO RELATED APPLICATIONS

This application is entitled to the benefit of provisional patent application No. 62/131,360 filed on Mar. 11, 2015, the specification of which is incorporated herein by reference.

BACKGROUND OF THE INVENTION

The present invention relates to a wearable attachment for massaging certain areas of the body.

DESCRIPTION OF THE PRIOR ART

A person needing a deep-tissue massage must typically visit a physical therapist's office, which is expensive and difficult to schedule. Furthermore, a poorly trained or unqualified therapist often provides an inadequate massage that can delay recovery or exacerbate injuries. Accordingly, there is currently a need for a device that allows a user to receive an immediate and effective massage. The present invention addresses this need by providing a plurality of wearable attachments, each having multiple air bladders that can be selectively inflated to simulate a conventional deep-tissue massage. A second embodiment includes attachments with mechanical rollers that are moved vertically and horizontally to simulate the massage.

SUMMARY OF THE INVENTION

The present invention relates to a wearable massager comprising a plurality of attachments, each of which is designed for a specific body part. Each attachment includes at least one massaging module on an inner surface that is either formed of mechanical rollers that simulate a massage as they are moved vertically and horizontally, or a plurality of contiguous, inflatable bladders that simulate a massage as they are inflated and rapidly deflated. A controller allows a user to vary the speed and intensity with which the rollers are moved horizontally and vertically, or the level, order and frequency in which each bladder is inflated and deflated. Accordingly, the continuous movement of the rollers or inflation and deflation of the bladders against the wearer's skin simulates the typical movements of a massage therapist's hands and fingers.

It is therefore an object of the present invention to provide a wearable attachment that simulates a deep-tissue massage.

It is therefore another object of the present invention to provide a wearable attachment having motorized rollers that can be moved horizontally and vertically to simulate various manual massage techniques.

It is yet another object of the present invention to provide a wearable attachment having a plurality of inflatable bladders that can be selectively inflated to simulate various manual massage techniques.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
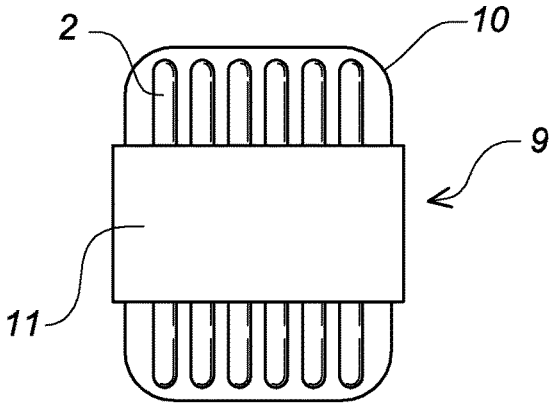
FIG. 1 is a plan view of the limb cuff.
Figure 2:
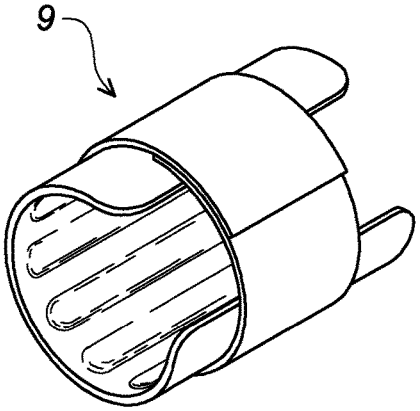
FIG. 2 is a perspective view of the cuff.
Figure 3:
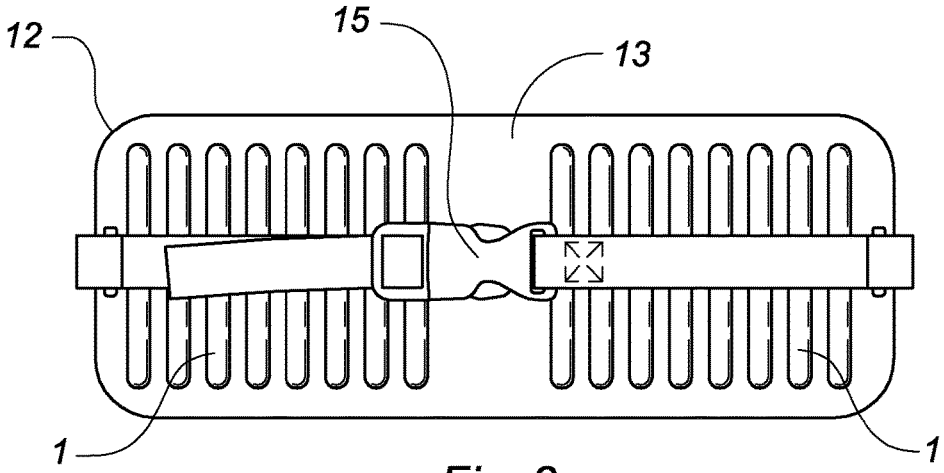
FIG. 3 is a plan view of the massaging belt.
Figure 4:
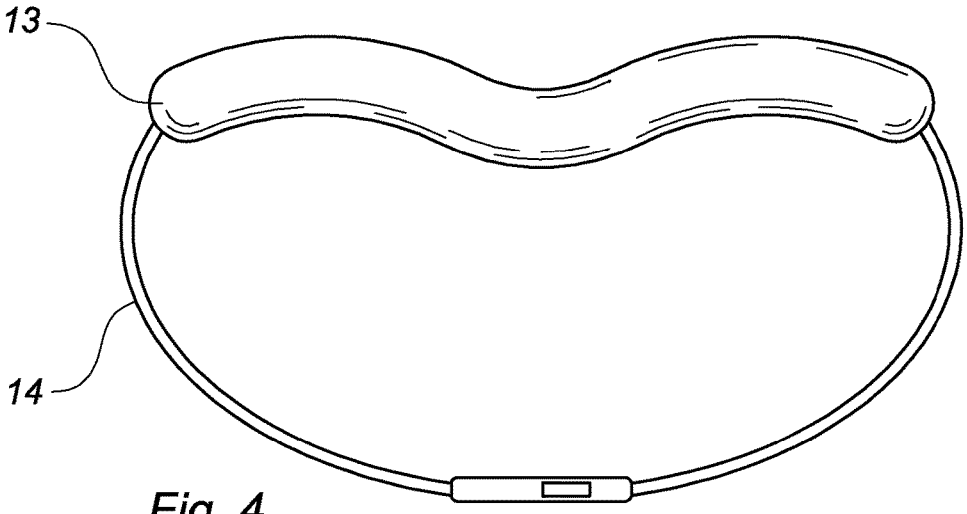
FIG. 4 is a top view of the belt.
Figure 5:
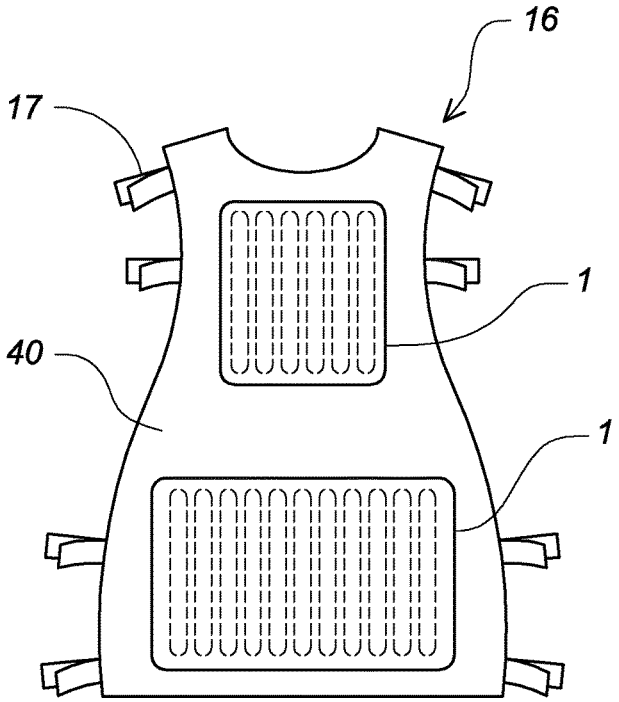
FIG. 5 depicts the vest.
Figure 6:
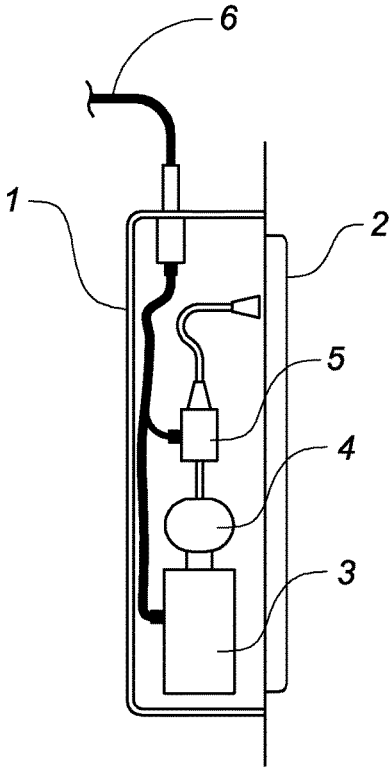
FIG. 6 is a cross-sectional view of an exemplary massaging module.
Figure 7:
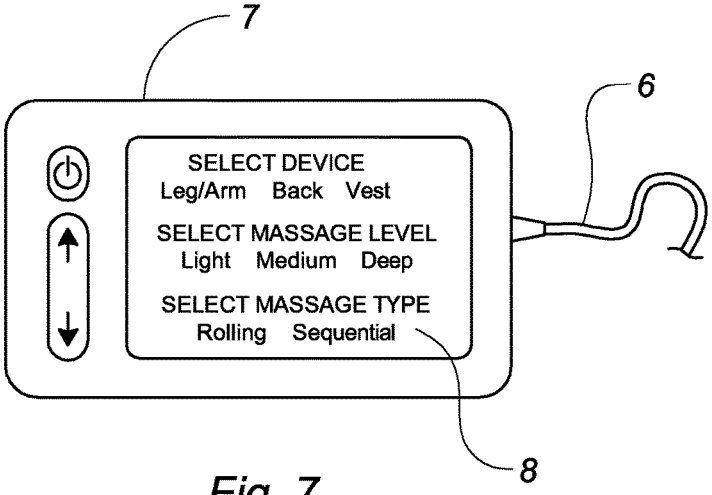
FIG. 7 is an isolated view of the controller.

The present invention relates to a wearable massager comprising a plurality of attachments, each of which is designed to fasten to a specific body part. Each attachment includes at least one massaging module 1 on an inner surface that engages a wearer's skin when the attachment is properly worn. In a first embodiment, as depicted in FIGS. 1-7, the module includes a plurality of contiguous, inflatable bladders 2 that simulate a manual massage as they are inflated and rapidly deflated. A pump 3 periodically pressurizes an air reservoir 4 that is in select fluid communication with the bladders. Each bladder includes a designated, two-way solenoid valve 5 for allowing airflow from the reservoir to the bladder, or for releasing air therefrom, upon receiving a discrete command from a controller 7, described, infra.

The module also includes a receptacle for receiving a communications cable 6 from the controller to regulate the inflation and deflation frequency of each bladder. The controller includes a touch screen 8 in communication with a smart-phone processor that allows a user to select a desired massage program. For example, a wearer can vary the maximum inflation level of each bladder and the frequency in which each bladder is inflated and deflated. The wearer can also dictate that all bladders inflate and deflate simultaneously, or that each bladder inflates separately and/or in succession to simulate a "rolling" massage of the type often performed by a therapist. The user can also enter the specific attachment being worn to assure proper operation and communication.

Each of the attachments is configured to massage a specific body part. For example, a first attachment 9 includes a cuff 10 with the massage module secured to the inner surface for treating an arm or a leg. A separable strap 11 with mating hook-and-loop fasteners allow the cuff to be easily secured around varying-sized limbs.

A second attachment 12 is a belt for massaging the lower back. The belt is formed of an elongated, pliable panel 13 having two spaced massage modules 1 on an inner surface. A separable strap 14 with a releasable buckle 15 secures the belt around a wearer's waist.

A third attachment 16 is a vest having an upper and a lower massage module on an inner surface of a rear panel 40 for treating both the upper and lower back. A front panel includes a plurality of separable straps 17 for securing the vest to a wearer's torso.

Accordingly, when the attachment is worn, a user can connect the controller to select a desired inflation and deflation routine. The continuous inflation and deflation of the bladders against the wearer's skin simulates the typical movements of a massage therapist's hands and fingers.

Figure 8:
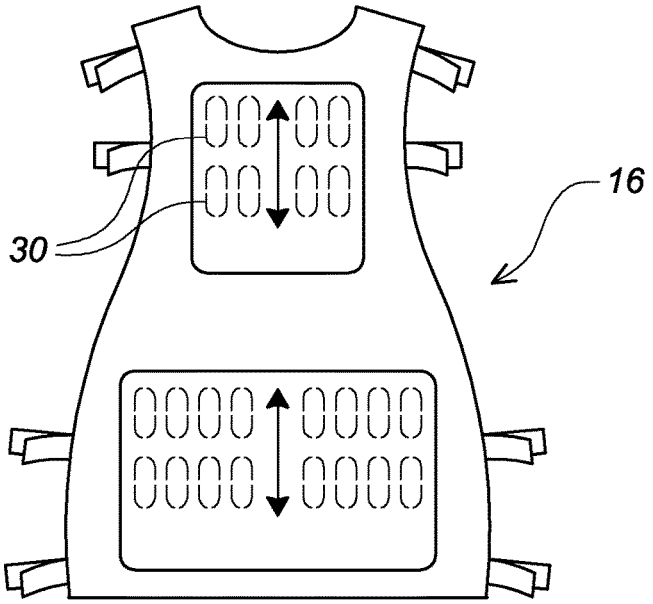
FIG. 8 depicts a second embodiment of a wearable massager according to the present invention.
Figure 9:
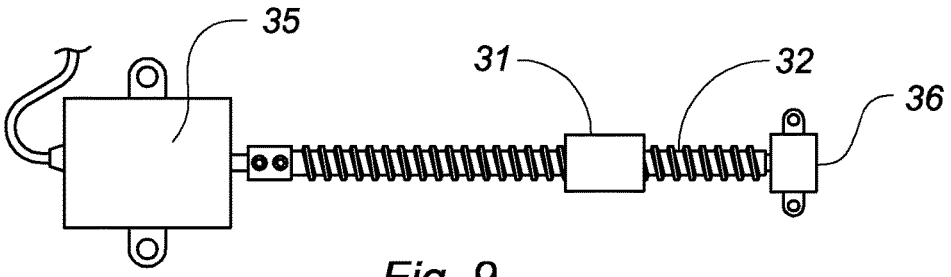
FIG. 9 is an isolated view of the ball-screw mechanism for vertical movement of the massaging rollers.
Figure 10:
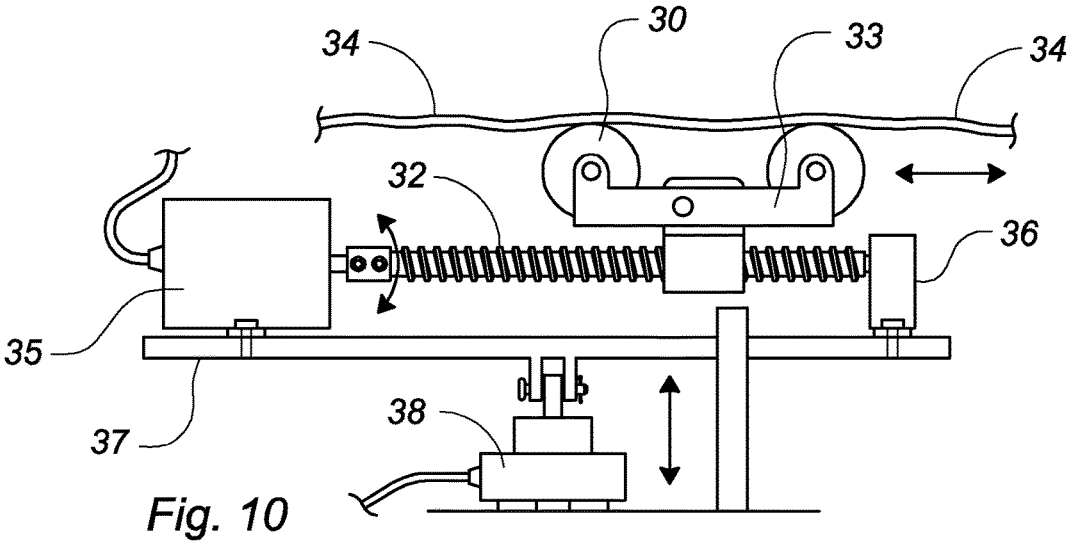
FIG. 10 depicts the entire mechanical massaging mechanism.

Now referring to FIGS. 8-10, a second embodiment is depicted that includes mechanical, motorized rollers 30 to simulate a desired massage in lieu of the air bladders. A means for moving said rollers vertically at a desired speed to stimulate a massage comprising a motor 25 and a drive screw 32. The massaging module is formed of an internally threaded block 31 mounted on an elongated, threaded drive screw 32. Attached to the block is a carriage 33 with one or more rollers 30 thereon that are positioned adjacent the inner surface 34 of the attachment so as to firmly engage a wearer's skin. A motor 35 rotates the screw to move the block and rollers upwardly and downwardly according to a given command from the controller. A distal end of the screw rotates within a support block 36.

The ball-screw assembly is mounted on the front surface of a platform 37 that is positioned within the attachment. A means for horizontally reciprocating said rollers toward and away from the wearer to further stimulate a massage technique comprising a solenoid actuator 38. Attached to the rear surface of the platform is a "tapping" solenoid actuator 38 that moves the rollers toward and away from the wearer upon receipt of a predetermined command from the controller. Accordingly, the wearer can select a heavy tapping massage whereby the solenoid extends and retracts the platform within a greater range, or a lighter tapping massage whereby the solenoid extends and retracts the platform within a shorter range and with less force. The controller also allows the user to program the speed with which the solenoid actuator, and thus the rollers, are extended and retracted. Although FIGS. 8-10 only depict a vest 16, the mechanical roller assembly is incorporated into the limb cuff and belt as well.

Accordingly, when the attachment is worn, a user can connect the controller to select a desired roller movement, i.e., vertically at high or low speed, or horizontally with minimal or extreme force. The continuous vertical and horizontal movement of the rollers against the wearer's skin simulates the typical movements of a massage therapist's hands and fingers. The controller is configured to individually and separately operate the massaging modules to allow the wearer to configure a desired massage technique similarly to the inflatable bladders as set forth above.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. A wearable massager comprising:

an attachment configured to secure to a specific body part, said attachment having an outer surface and an inner surface;

at least one massaging module within said attachment and adjacent to the interior surface to engage a wearer's skin when the attachment is worn, said massaging module including a plurality of rollers;

means for moving said rollers vertically at a desired speed to simulate a massage, wherein said means for moving said rollers vertically at a desired speed comprises:

a threaded block mounted on an elongated, threaded drive screw, said rollers mounted on said block;

a motor connected to said drive screw whereby said motor rotates said drive screw to axially translate said block to vertically move said rollers;

means for horizontally reciprocating said rollers toward and away from the wearer to further simulate a massage technique, wherein said means for horizontally reciprocating said rollers comprises a platform having a front surface and a rear surface, said motor and said drive screw attached to the front surface of said platform, a solenoid actuator attached to the rear surface of said platform, and a control means for extending and retracting said actuator a select distance and at a select speed to move said rollers toward and away from a wearer to simulate a tapping massage.

2. The wearable massager according to claim 1 wherein said attachment is a cuff having a separable strap with mating hook-and-loop fasteners to allow the cuff to be easily secured around varying-sized limbs.

3. The wearable massager according to claim 1 wherein said attachment is a belt for massaging the lower back, said belt formed of an elongated, pliable panel with a separable strap having a fastener thereon for securing the belt around a wearer's waist.

4. The wearable massager according to claim 1 wherein said attachment is a vest having an upper massage module and a lower massage module on an inner surface of a rear panel for treating both an upper and a lower back.

* * * * *